United States Patent [19]

Cullen et al.

[11] 4,003,435

[45] Jan. 18, 1977

[54] METHOD AND APPARATUS FOR DEPLOYMENT AND RETRIEVAL OF FIXED LENGTHS OF ELECTRICAL CABLE INTO AND FROM A WELL BORE

[75] Inventors: Roy H. Cullen; Joshua M. Jackson; Jim Witovek, Jr.; Terry V. Jones, all of Houston, Tex.

[73] Assignee: General Electric Company, by said Joshua M. Jackson and Jim Witovak, Jr.

[22] Filed: Oct. 9, 1975

[21] Appl. No.: 621,131

[52] U.S. Cl. ..... 166/315; 166/77; 166/65 R

[51] Int. Cl.[2] ..... E21B 23/00; E21B 19/08

[58] Field of Search ..... 166/77, 75, 315, 65, 166/67, 71, 63; 254/175.5, 175.6, 175.7; 191/12.2 R, 12.2 A, 12.4

[56] References Cited

UNITED STATES PATENTS

| | | | |
|---|---|---|---|
| 3,285,629 | 11/1966 | Cullen et al. | 166/65 UX |
| 3,306,357 | 2/1967 | Cullen et al. | 166/63 |
| 3,373,818 | 3/1968 | Rike et al. | 166/77 |
| 3,690,136 | 9/1972 | Slator et al. | 166/77 X |
| 3,920,076 | 11/1975 | Laky | 166/77 X |

*Primary Examiner*—Stephen J. Novosad
*Attorney, Agent, or Firm*—Pravel, Wilson & Gambrell

[57] ABSTRACT

A method and apparatus for handling electrical cable sections having substantially rigid connectors at the end of each section, wherein the entire fixed length of one or more sections of cable are positioned in and removed from a well bore by rapidly inserting and withdrawing a section of cable employing a rig floor assembly in combination with a cable supply and storage apparatus which are respectively provided with means for preventing excessive bending of the cable terminal connectors and the cable conductor at an interface between the conductor and connectors to prevent damage thereto during insertion and removal.

20 Claims, 12 Drawing Figures

12e
12d
23
84
20
31a
31c
30
32a
31d
24
82
31
31b
10
21b
T1
12b
10c
33a
25
10a
12
21c
25d
21
25a
45
25b
25f
54
50
25e
12f
40
12g
19a
43
19
19b
12a
42
18d
18
18b
41
44
18a
E 12e
12d
25
25a
25b
20
25d
21c
T1
31a
31c
30
82
84
32a
31d
10b
22a
21
10a
31
24
10c
31b
21b
33a
12b
23
14a
12
12g
E
45
10
C
12f
50
54
19
40
43
12a
42
18a
44
18
41

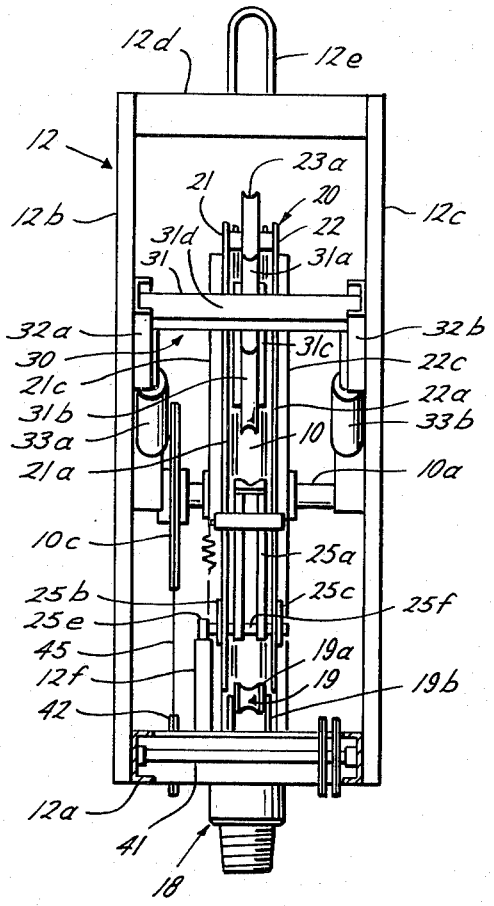
Fig. 5
Fig. 6
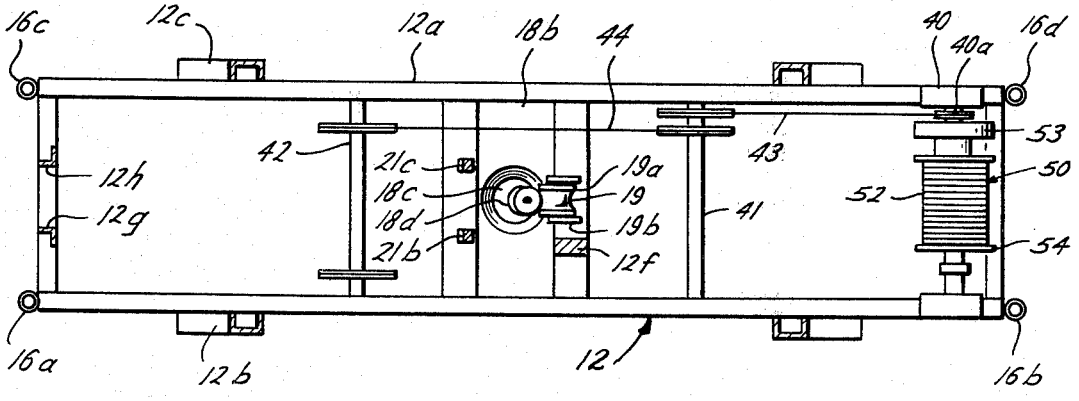

METHOD AND APPARATUS FOR DEPLOYMENT AND RETRIEVAL OF FIXED LENGTHS OF ELECTRICAL CABLE INTO AND FROM A WELL BORE

BACKGROUND OF THE INVENTION

This invention relates to the handling of electrical cable in fixed lengths and more particularly pertains to positioning an entire length of one or more sections of cable in a well bore and removing same.

There are processes and apparatus that have been described in the art for installing and removing continuous tubular members, such as continuous well tubing, well logging telementry cable, electrical cable, and the like, in and from a well bore. By way of example, the following U.S. Patents describe techniques and apparatus for inserting and removing continuous tubing into and from wells: U.S. Pat. Nos. 3,313,346; 3,667,554; 3,690,136; 3,658,270; 3,866,679; 3,841,407; and 2,013,070. Additionally, U.S. Patent Nos. 3,378,811 and 3,285,629 describe methods and apparatus for mounting an electrical cable in a flexible drilling hose for positioning in a well bore. Further, the following U.S. Patents describe techniques and apparatus for installing and removing lengths of electrical cable in and from a well bore: U.S. Pat. Nos. 2,326,556; 3,825,078; 3,825,079; and 3,807,502.

However, so far as is known, no one previously has provided a satisfactory method or apparatus for handling electrical cable into or out of a well wherein the entire length of one or more sections of the cable were inserted or removed, particularly where the cable terminal connectors have to be handled on reels and sheaves.

SUMMARY OF THE INVENTION

Accordingly, the present invention provides a new and improved method and apparatus for feeding and withdrawing the entire fixed length of one or more sections of an electrical cable having substantially rigid terminal connectors at the end of each section into and from a well bore while preventing excessive bending of the cable terminal connectors and the cable conductor at interfaces between the conductor and terminal connectors of each cable section.

BRIEF DESCRIPTION OF THE DRAWINGS

A preferred embodiment of the apparatus of this invention, suitable for practicing the method of this invention, is shown in the drawings, wherein

FIG. 5 is an and view taken along line 5—5 of FIG. 4 illustrating the rig floor sheave assembly of the apparatus;

FIG. 6 is a plan view taken along line 6—6 of FIG. 4 illustrating the rig floor sheave assembly power transfer means and the positioning of the electrical cable in the well bore;

DESCRIPTION OF THE PREFERRED EMBODIMENT

Figure 1:
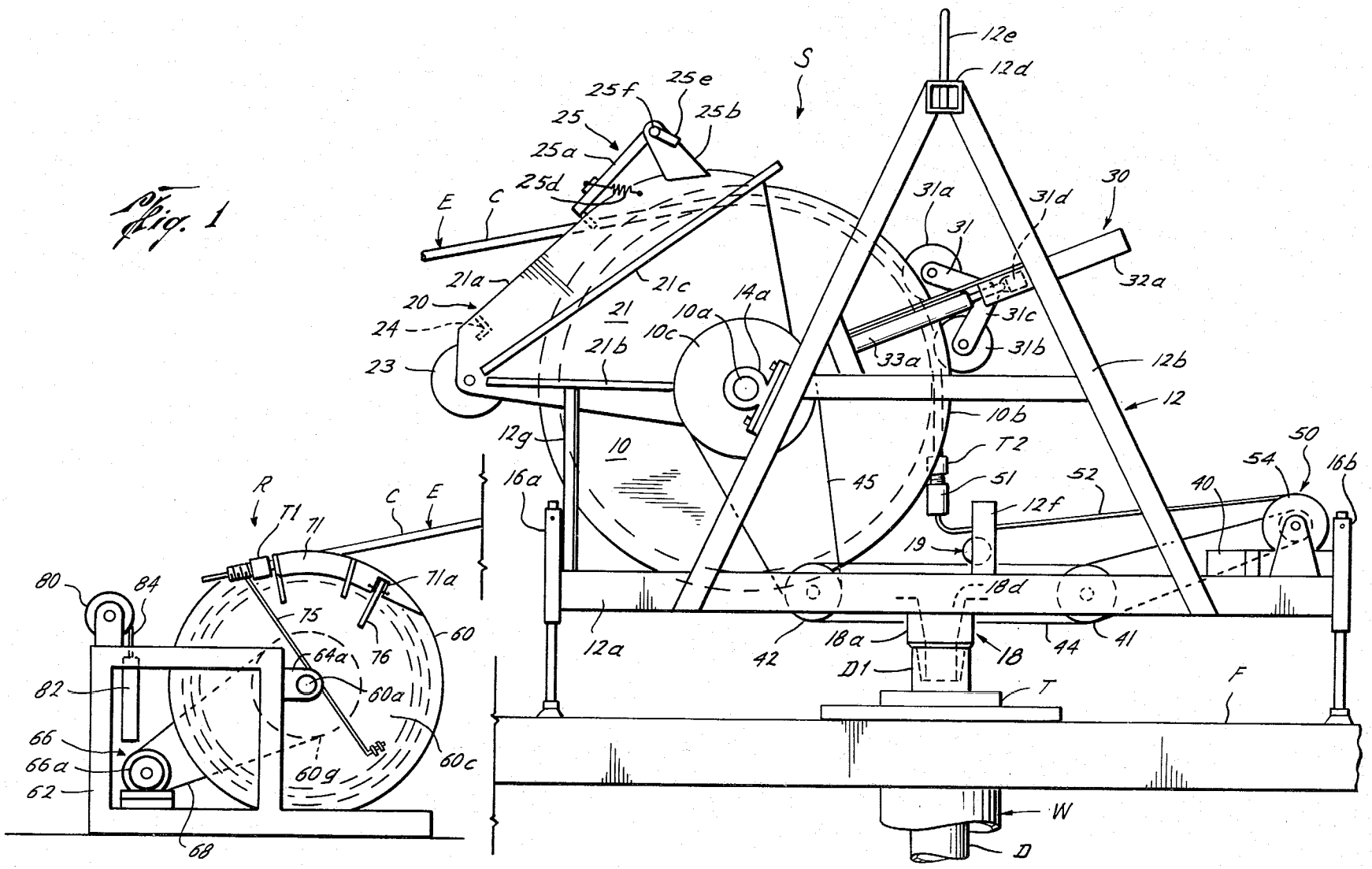
FIG. 1 is a side view of a preferred embodiment of the apparatus shown in position for feeding a section of electrical cable into a well bore.

In the drawings, the letter E generally designates a fixed length of electrical cable which includes one or more electrical conductors formed into an insulated conductor section C having a male terminal connector T1 (FIGS. 2 and 3) and a female terminal connector T2 (FIG. 1), respectively connected at each end. The terminal connectors T1, T2 are usually substantially rigid and have diameters greater than the conductor section C diameter to facilitate the coupling of a plurality of cables E positioned in a well bore and to support the cables in the well bore. The electrical cable E may be of any desired length and size. However, as will become more readily apparent from the following description, the method and apparatus of the present invention are particularly adapted to handle relatively long lengths of cable sections, e.g. 1,000 to 5,000 ft., constructed of a plurality of relatively large diameter conductors suitable for transporting power and telemetry signals between the surface and a down-hole electrically powered drilling apparatus.

Figure 4:
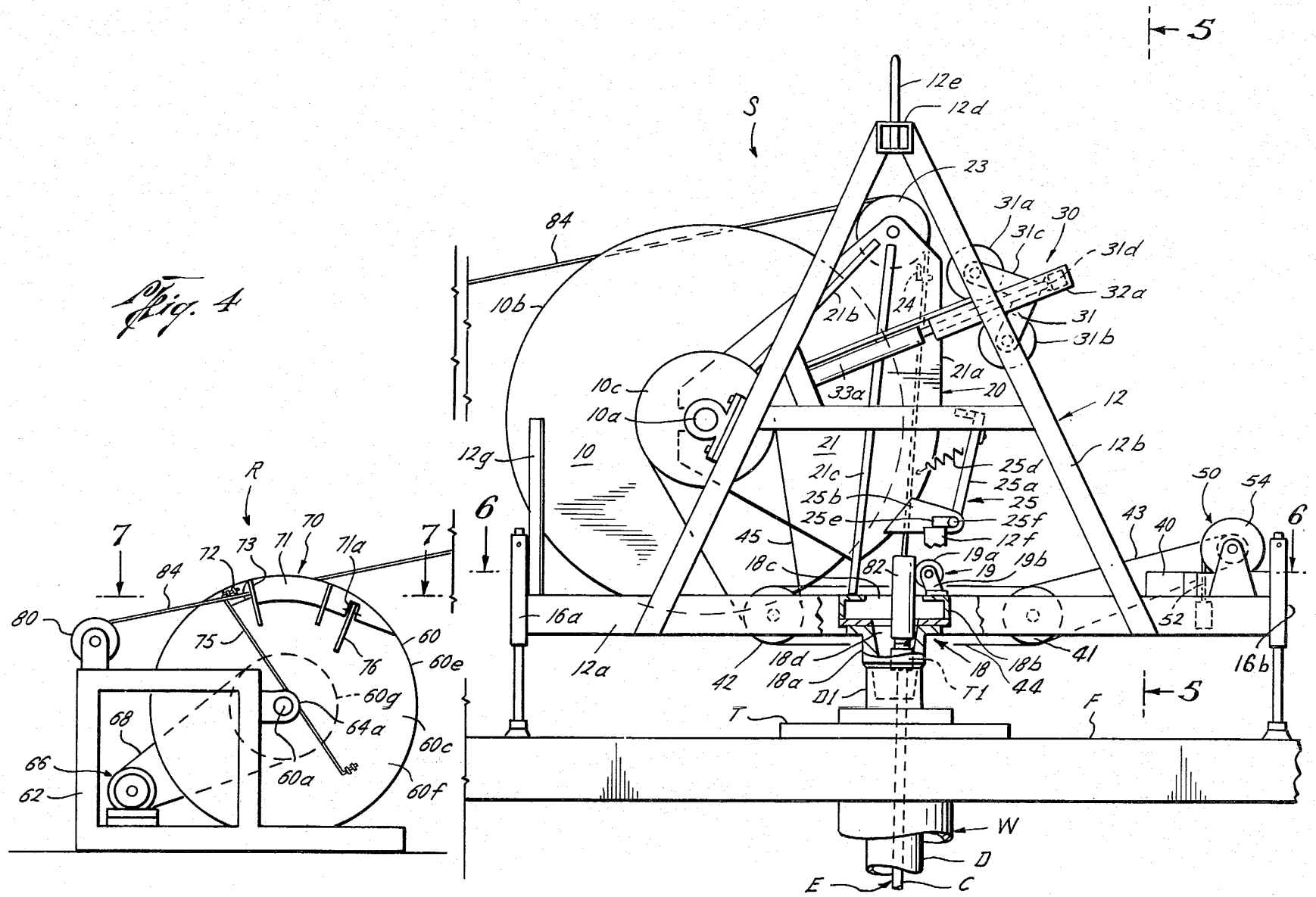
FIG. 4 is a side view of the apparatus, similar to FIG. 1, but shown in position for withdrawing the fixed length of electrical cable section positioned in the well bore.

Referring now to FIGS. 1 and 4 of the drawings, the apparatus of the present invention includes a rig floor sheave assembly, generally designated as S, and a cable supply and storage reel apparatus, generally designated as R. The rig floor sheave assembly S is adapted for positioning on the well rig floor F over the well bore, generally W, for the insertion and withdrawal of the length of electrical cable E into and from the well bore W. The cable supply and storage reel apparatus R may be positioned remotely from the rig floor F at a desired location and is adapted for supplying and receiving the electrical cable E to and from the rig floor sheave assembly S during the cable feeding and withdrawal.

As illustrated in the drawings, the rig floor sheave assembly S includes a relatively large diameter sheave 10 having a shaft **10*a* which is rotatably mounted for axial rotation with a frame 12 by suitable means, such as a pair of pillow blocks 14***a*, (not shown). The frame 12 is constructed to position the sheave over the well bore whereby a portion of the sheave outer circumferential edge 10*b* is positioned substantially in axial alignment with the well bore axis. Such positioning of the sheave 10 permits the electrical cable E to be disposed on the sheave 10 and fed or withdrawn to or from the well bore W substantially tangentially relative to the well bore axis.

More particularly, the frame 12 includes a base frame member 12*a*, a pair of spaced, substantially parallel upstanding "A"-frame members 12*b*, 12*c* mounted thereon and a cross-frame support member 12*d* connected with the A-frame members 12*b*, 12*c* at their respective upper ends. The sheave 10 is disposed between the A-frame members 12*b*, 12*c* and mounted therewith for axial rotation by means of the pillow blocks 14*a*, (not shown).

The frame 12 is provided with a plurality of adjustable legs 16*a*, 16*b*, 16*c* and 16*d* which are mounted with the base frame 12*a* and are of conventional construction to support the assembly S on the well rig floor F a desired distance therefrom. A hoistline bail 12*e* is also provided with the cross-frame support member 12*d* to facilitate lifting of the assembly S for positioning on the rig floor F over the well bore W.

As illustrated in the drawings, a means 18 is provided for rotatably connecting the rig floor sheave assembly S with well apparatus disposed over or in the well bore W, preferably the upper end of a tubular drill string D positioned in the well bore W (FIGS. 1 and 4). The rotatable connector means 18 is aligned with a portion of the sheave outer circumferential edge 10*b* so that the electrical cable E positioned on the sheave 10 is substantially in axial alignment with the connector means 18. The rotatable connector means 18 permits the drill string D to be axially rotated while connected with the rig floor sheave assembly during feeding and withdrawal of the cable E into the drill string D to facilitate cable insertion and removal.

More particularly, the rotatable connector means 18 preferably includes a threaded rotating tool joint pin 18*a* adapted for threaded connection with a box end D1 of the tubular drill string D which is rotatably mounted with a support member 18*b* fixedly connected to the base frame member 12*a* (FIG. 4). The support member 18*b* has an opening 18*c* in alignment with the rotating tool joint pen annulus 18*d* through which the electrical cable E passes during insertion and removal to and from the tubular drill string D. Suitable handles or the like (not shown) may be mounted with the tool joint pin 18*a* for facilitating connection with the tubular drill string D, if desired.

As illustrated in the drawings, a cable guide roller assembly 19 is provided adjacent the opening 18*c* to facilitate the passage of the electrical cable E through the rotating tool joint annulus 18*d* as the cable E is fed and withdrawn over the sheave 10*b*. The guide roller assembly 19 includes a guide roller 19*a* rotatably mounted on a bracket 19*b* which is in turn fixedly mounted with the support member 18*b* (FIG. 6).

Figure 3:
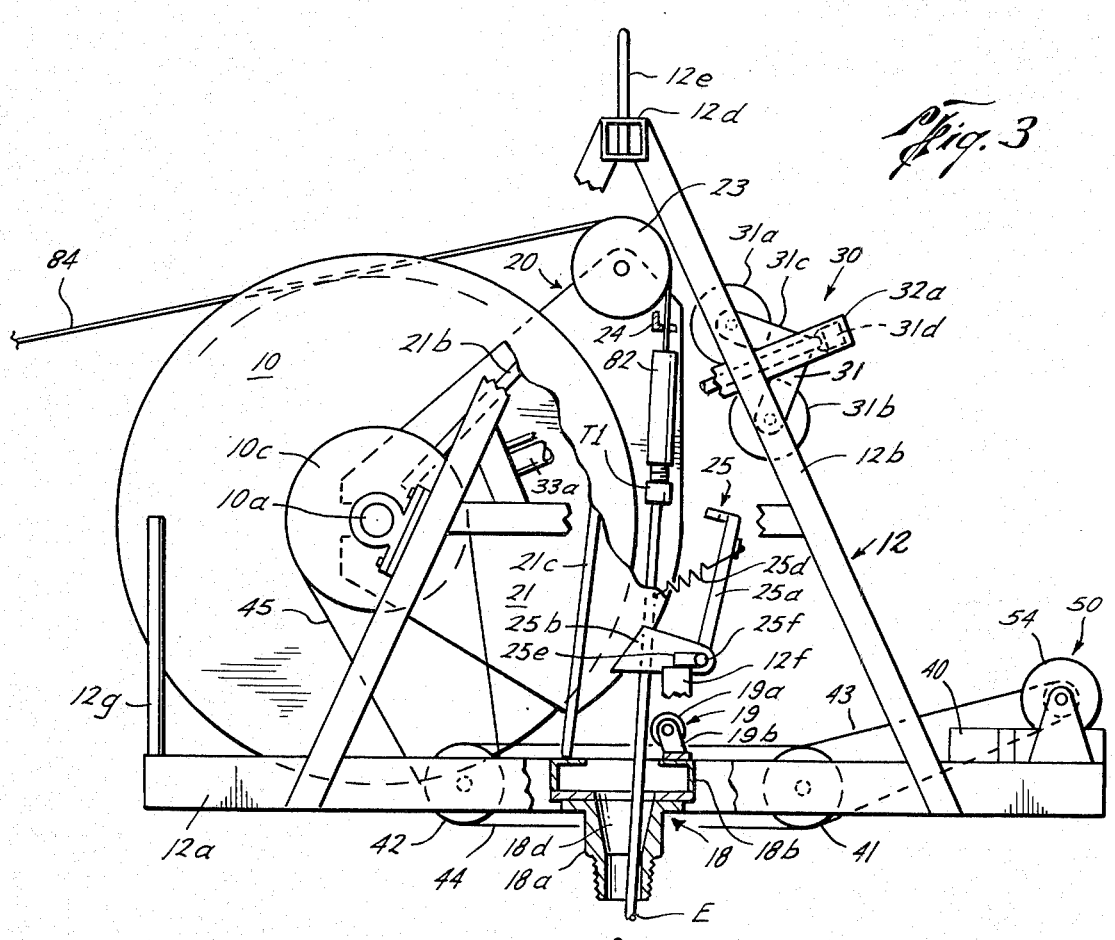
FIG. 3 is a view, partially cut away, of the rig floor sheave assembly, similar to FIG. 2, but shown in position after the electrical cable terminal connector has been arcuately moved from the position illustrated in FIG. 2 when the cable is being fed into the well bore.
Figure 2:
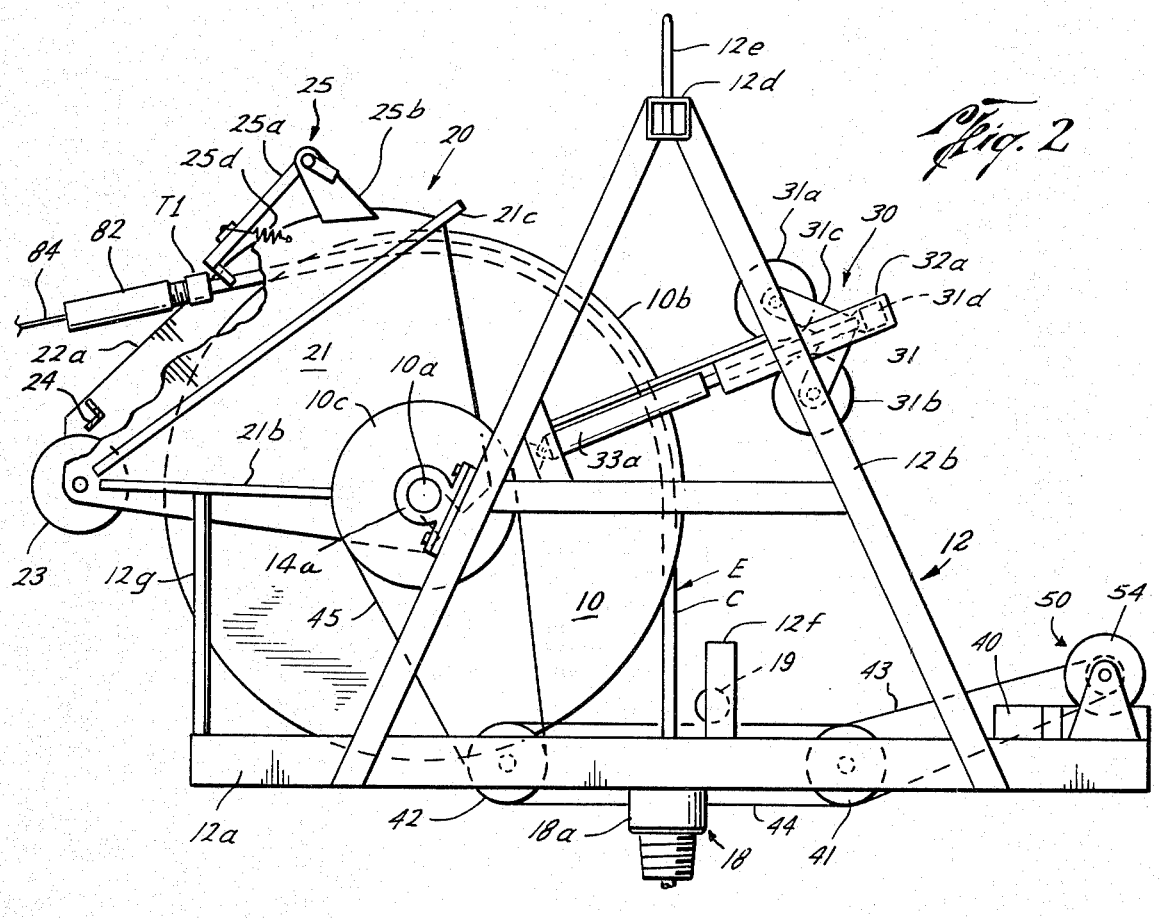
FIG. 2 is a side view, partially cut away, of the rig floor sheave assembly of the apparatus illustrated in position for supporting and arcuately moving the trailing terminal connector of the electrical cable when the cable is being fed into the well bore.

In accordance with the present invention, the rig floor sheave assembly S includes a terminal connector anchor carrier assembly, generally 20, for supporting and arcuately carrying the cable terminal connector T1 separately from the sheave 10 when the cable E is being fed into or withdrawn from the well bore W. Separate support and arcuate movement of the connector T1 prevents excessive bending of the terminal connector T1 and the cable conductor C at an interface between the terminal connector T1 and the conductor C and the development of excessive mechanical stress concentrations at the interface as they are carried over the sheave 10. The cable anchor carrier assembly 20 is disposed about the sheave 10 and is adapted for limited axial rotation relative thereto between a first position somewhat forward of the sheave for receiving the terminal connector T1 during cable feeding before it reaches the sheave 10, as illustrated in FIG. 2, and a second position above the rotating connector means 18 for positioning the connector T1 in substantial axial alignment with the tubular drill string D, as illustrated in FIG. 3.

The cable anchor carrier assembly 20 includes a pair of substantially parallel support plates 21, 22 positioned on each side of the sheave 10 substantially parallel thereto which are mounted with the sheave drive shaft 10*a* for the independent axial rotation relative to the sheave 10. Both of the support plates 21, 22 extend outwardly from the sheave outer circumferential edge 10*b* and are provided with outer edges 21*a*, 22*a*, respectively. A rotatable winch cable sheave 23, a cable connector stop member 24 and a releasable connector catch means, generally 25, for supporting the terminal connector T1 are respectively provided between the support plates 21, 22 adjacent the respective outer edges 21*a*, 22*a* outward from the sheave circumferential edge 10*b*. As more particularly described hereafter, the winch cable sheave 23, connector stop member 24, and releasable connector catch means 25 cooperate to support the electrical cable terminal connector T1 between the carrier assembly support plates 21, 22 outwardly from and above the sheave circumferential edge 10*b* for arcuate movement relative thereto while the cable E is being fed into or removed from the well bore W which essentially prevents aforementioned excessive bending.

More particularly, the releasable catch means 25 includes a catch member 25*a* adapted for pivotal movement between the support plates 21, 22 for catching the terminal connector T1 as the electrical cable E is fed over the sheave outer circumferential edge 10*b* between the support plates 21, 22 during cable feeding. The catch member 25 is pivotally mounted with a pair of outwardly extending base members 25*b*, 25*c* which are respectively mounted with the support plate outer edges 21*a*, 22*b* and is forcibly held in position between the plates 21, 22 by means of a spring 25*d* connected therewith and with the support plate 21. As illustrated in FIG. 2, during cable feeding the catch member 25*a* catches the terminal connector T1 as it approaches the sheave 10 and forcibly supports it between the support plates 21, 22 outwardly from the sheave edge 10*b* for arcuate movement with the carrier assembly from the aforementioned first forward position to the aforementioned second position (FIG. 3). A dog 25*e* is mounted with the catch member shaft 25*f* which is adapted to engage an upstanding butt 12*f* on the frame base member 12*a* when the anchor carrier assembly 20 is moved to the aforementioned second position (FIG. 3) for pivoting the catch member 25*a* outwardly from between the support plates 21 and 22 thereby releasing the cable terminal connector T1 therefrom for continued feeding into the tubular drill string D.

Each support plate 21, 22 is provided with a pair of stop elements 21*b*, 21*c* and 22*b*, 22*c* for engaging certain portions of the assembly frame 12 to limit the axial rotation of the carrier assembly 20 to slightly over 90°. As illustrated in FIGS. 1 and 2, the stop elements 21*b*, 22*b* engage the upstanding frame stops 12*g*, 12*h* provided with the base member 12*a* for positioning the cable anchor carrier assembly in the aforementioned forward first position while the stop elements 21*c*, 22*c* engage the frame base member 12*a* for positioning the carrier assembly 20 in the aforementioned second position above the rotatable connector means 18 (FIG. 3).

The rig floor sheave assembly S also includes means, generally 30, for increasing frictional forces between the sheave 10 and the electrical cable E when the cable is positioned on the sheave 10 to prevent slippage therebetween while the cable E is being fed into or removed from the well bore W. As illustrated, the friction increasing means 30 is disposed about the sheave 10 and includes a cable squirter wheel assembly 31 positioned outwardly from the sheave outer circumferential edge 10*b* adapted for releasably engaging the electrical cable E when it is positioned on the sheave 10. More particularly, the squirter wheel assembly 31 is disposed between a pair of inwardly channeled frames 32*a*, 32*b* respectively mounted with the assembly A-frame members 12*b* and 12*c* and is adapted for longitudinal movement inwardly and outwardly relative to the sheave circumferential edge 10*b*. The relative inward and outward movement is provided by a pair of telescoping members 33*a* and 33*b*, such as hydraulic cylinder-piston assemblies, respectively mounted with the A-frames 12*b* and 12*c* and the squirter wheel assembly 31.

The squirter wheel assembly 31 further includes a pair of squirter wheels 31*a* and 31*b* rotatably mounted in tandem with a wheel frame 31*c* which is in turn rotatably mounted with a squirter carriage member 31*d* disposed between the channeled frame members 32*a* and 32*b* and has the telescoping members 33*a*, 33*b* connected therewith.

When it is desirable to prevent slippage between the electrical cable E and the sheave 10, such as during initial feeding of the electrical cable E into the well bore W, the telescoping members 33*a*, 33*b* are activated to move the squirter wheel assembly 31 inwardly relative to the sheave circumferential edge whereby the squirter wheels 31*a*, 31*b* engage the cable E and force it downwardly on the sheave 10 as shown in FIG. 1. Such downward force can be readily released by the reverse outward relative movement of the squirter wheel assembly 31 as shown in FIG. 2.

Preferably, the rig floor sheave assembly includes a power means 40 mounted with the base frame 12 for powering the axial rotation of the sheave 10 to permit the electrical cable E to be rapidly driven into and from the well bore W when desired during insertion and withdrawal with respect thereto. The power means 40 may be any conventional power source, such as a hydraulic motor, an electrical motor, and the like, and may be connected with the sheave 10 by employing any conventional drive system for transporting a driving force to the sheave 10. As illustrated in FIGS. 5 and 6, a drive chain and sprocket system may be employed which, for example, may include a pair of sprocketed shafts 41, 42 rotatably mounted in alignment with respect to each other on the base frame member 12*a* and connected with a power source sprocket 40*a*, to each other and to a sheave sprocket 10*c* fixedly mounted with the sheave drive shaft 10*a* by means of suitable drive chains 43, 44 and 45, respectively. The power transfer system also includes a suitable apparatus for engaging and disengaging the transfer of power between the power source 40 and the sheave 10, such as a clutch or the like (not shown) which may be mounted in the chain and sprocket system in a conventional manner, such as with the sheave drive shaft 10*b*, sheave sprocket 10*c*, or the power source 40.

The rig floor sheave assembly S is further provided with a winch assembly 50 mounted with the frame base member 12*a* for transporting one end of the electrical cable section E from the cable supply and storage assembly R to the rig floor sheave assembly where it may be positioned on the sheave 10 for feeding into the well bore W and, if desirable, for transporting the electrical cable E under tension from the sheave assembly S to the reel assembly R under tension after it has been withdrawn from the well bore W for storage. As illustrated in the drawings, the winch assembly 50 is mounted on the frame base member 12*a* rearward to the sheave 10 in relationship to the direction of feeding and withdrawing the electrical cable E by the sheave 10. The winch assembly 50 is provided with a specially designed connector 51 swivally mounted with the end of the winch cable 52 and is adapted for threadable connection with one of the electrical cable terminal connectors T1, T2, preferably the female connector T2 (FIG. 1). The winch cable connector 51 is specially designed to protect the electrical terminal connector T2 from damage during transportation between the rig floor sheave asssembly S and the reel assembly R. The winch assembly 50 is also connected with the power source 40 by any conventional power transfer system, such as a gear box 53 and includes a conventional power engaging-disengaging apparatus (not shown) for rotationally driving the winch reel 54 having the winch cable 52 connected therewith for helical winding and unwinding with respect thereto.

Referring now to FIGS. 4–9A of the drawings, the electrical cable supply and storage reel apparatus R of the present invention includes a reel 60 having an axial shaft 60*a* which is mounted for rotation on a support frame 62 by conventional means such as pillow blocks 64*a*, 64*b*. The reel 60 is, generally speaking, of conventional construction having a cylindrical portion 60*b* and circular end walls 60*c*, 60*d* with diameters greater than the cylindrical portion 60*b* so as to retain the electrical cable E on the cylindrical portion 60*b* as it is helically wound and unwound with respect thereto. However, the supply reel 60 is further provided with a releasable means, generally 70, for positioning the electrical cable terminal connector T1 on the reel 60 for rotation therewith and for releasing the terminal connector T1 when the cable E is unwound therefrom. The releasable means 70 protects the terminal connector T1 and the cable conductor C from excessive bending moments during cable winding and unwinding and thereby prevents damage thereto.

As illustrated in the drawings, the releasable means, generally 70, is mounted with the reel end wall 60*c* substantially adjacent its circumferential edge 60*e* for positioning the cable terminal connector T1 for rotation with the reel 60 outwardly adjacent the circular end wall outer surface 60*f*. More particularly, the releasable means 70 includes an outwardly extending flange member 71 fixedly mounted with end wall outer surface 60*f* and a gate member 72 pivotally mounted with the end wall 60*c*. Also included is a cable connector catch plate 73 perpendicularly mounted between the end wall outer surface 60*f* and the outwardly extending flange 71 having a groove 73*a* for receiving the cable E.

Figure 7:
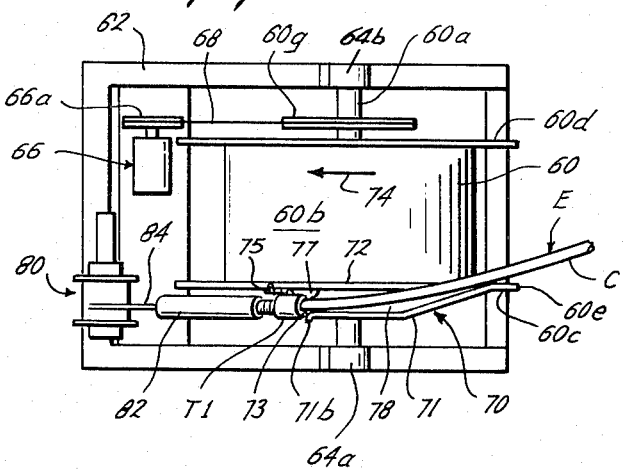
FIG. 7 is a plan view of the cable supply and receiving apparatus of the invention taken along line 7—7 of FIG. 4 shown in position for receiving the electrical cable terminal connector for winding the length of electrical cable on the reel of the apparatus as the cable is withdrawn from the well bore.
Figure 7A:
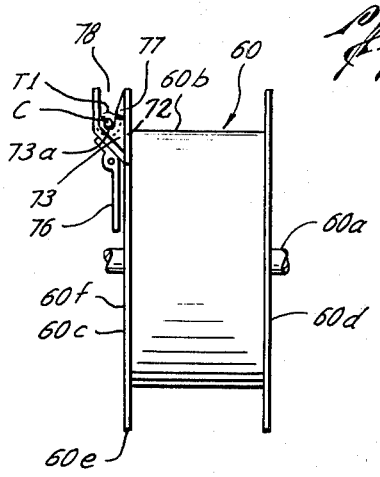
FIG. 7A is an end view of the reel as illustrated in FIG. 7.

As illustrated in FIGS. 7 and 7A, the outwardly extending flange 71 and pivotal gate member 72 are mounted substantially adjacent to the end wall upper edge 60*e* and to each other forming a space 78 therebetween for receiving a portion of the electrical cable E upon rotation of the reel 60 in the direction shown by the arrow 74.

Figure 8:
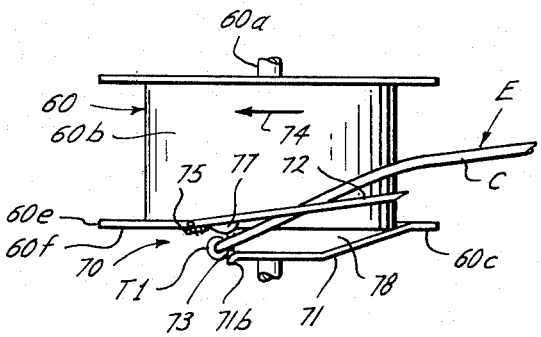
FIG. 8 is a plan view of the cable supply and receiving apparatus reel showing the positioning of the electrical cable and its terminal connector on the reel as the reel is rotated from the position illustrated in FIGS. 7 and 7A when the cable is being wound thereon and withdrawn from the well bore.
Figure 8A:
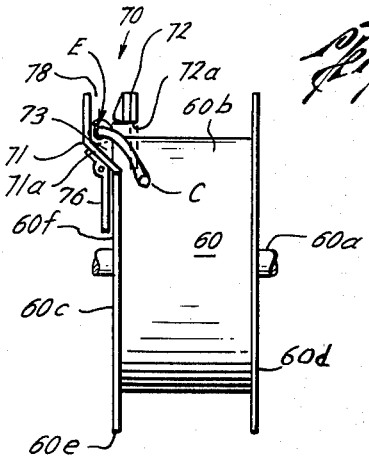
FIG. 8A is an end view, partially in cross-section, of FIG. 8.

The pivotal gate member 72 is adapted for pivotal movement between a first position in substantial alignment with the circular end wall circumferential edge 60*e* and a second position inwardly thereof over the cylindrical reel portion 60*b* (FIGS. 8, 8A). Additionally, the pivotal gate member 72 has an arcuate-shaped lower edge 72*a* (FIG. 8A) which is spaced from the cylindrical reel portion 60*b* a sufficient distance to permit the passage of the electrical cable conductor portion C thereunder. The gate member 72 is forcibly held in the aforementioned first position in alignment with the end wall edge 60*e* by means of a spring element 75 mounted with the end wall outer surface 60*f* and the gate member 72.

Figure 9:
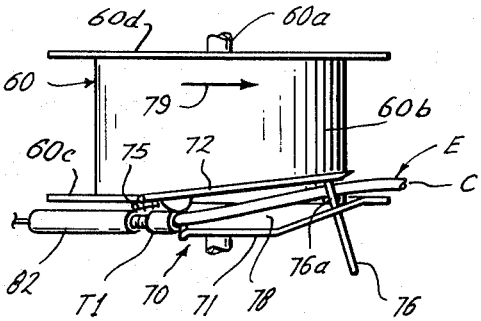
FIG. 9 is a plan view of the cable supply and receiving apparatus reel shown in position for releasing the electrical cable and its terminal connectors therefrom when the cable is unwound for feeding into the well bore.
Figure 9A:
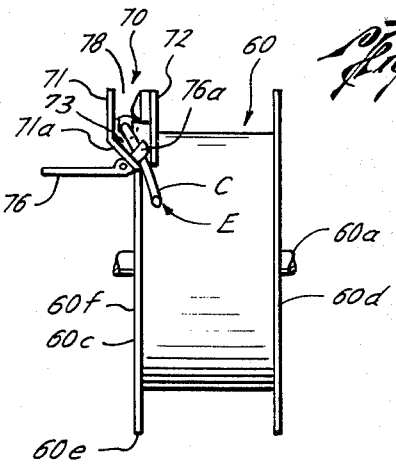
FIG. 9A is an end view of FIG. 9.

Additionally, a trigger member 76 having a protrusion 76*a* is pivotally mounted on the flange 71 adjacent a flange opening 71*a* which is adapted to engage the gate member 72 and move it from the aforementioned first aligned position to the aforementioned second inward position for releasing the electrical cable E and its terminal connector T from the reel 60 during unwinding (FIGS. 9 and 9A).

Further, a connector guide member 77 is mounted with the pivotal gate member 72 and the outwardly extending flange 71 has a curved lip portion 71*b*, both positioned adjacent the connector catch plate member 73, to facilitate the positioning of the cable terminal connector T1 for engagement with the grooved catch plate 73.

As illustrated in FIGS. 7–9A, and beginning with FIGS. 7 and 7A, in the operation of the cable supply and reel assembly R, the electrical cable E is wound on the cylindrical reel 60 by initially positioning the cable terminal connector T1 in alignment for engagement with the connector catch plate 73. Upon rotation of the reel 60 in the direction of the arrow 74, the terminal connector T1 engages the grooved catch plate 73, the positioning of which is facilitated by the positioning member 77 and the flange lip portion 71*b*. During rotation, the cable conductor section C is moved downwardly in a receiving space 78 between the outwardly extending flange 71 and the gate member 72 until it comes into engagement therewith. Further rotation of the reel forces the cable conductor section downwardly between the gate member 72 and the flange 71 forcing the gate member to move from the first position in alignment with the end wall edge 60*e* (FIGS. 7 and 7A) towards the second inward position until the cable conductor section C engages the reel cylindrical portion 60 as illustrated in FIGS. 8 and 8A. Upon such engagement, the cable section C passes under the gate member lower edge 72*a* thereby permitting the gate member 72 to forcibly move back to the first aligned position as it is illustrated in FIGS. 7 and 7A. Further continued rotation of the reel 60 in the direction of the arrow 74 causes the electrical cable E to be helically wound on the reel cylindrical portion 60*b* between the end walls 60*c* and 60*d* with the cable terminal connector T1 being positioned outwardly therefrom adjacent the end wall outer surface 60*f*. The terminal connector T1 and the cable conductor C are thus protected from excessive bending moments. Additionally, the positioning of the terminal connector T1 outwardly of the cylindrical reel portion permits access thereto so that the electrical continuity of the electrical cable E can be tested while helically wound and stored on the reel assembly R.

In order to remove the cable E and its terminal connector T1 from the reel 60 after it has unwound therefrom, except for that portion positioned between the flange 71 and gate member 72, the trigger member 76 is moved to engage its protrusion 76*a* with the gate member 72 forcing it to the second inward position, as illustrated in FIGS. 9, 9A. In the position illustrated, a portion of the electrical cable E is disposed adjacent the reel end wall 60*c*. Thus, by rotating the reel 60 in the direction indicated by the arrow 79 in FIG. 9, the cable E moves upwardly between the gate member 72 and flange member 71 and outwardly therefrom with simultaneous movement of the terminal connector T1 upwardly and outwardly from the grooved catch plate 73 thereby providing cable release from the reel 60. During such upward and outward movement of the cable E, it contacts the trigger protrusion 76*a* and forces it from engagement with the gate member 72 permitting the gate member 72 to forcibly return from the inward second position to the first position in alignment with the reel end wall edge 60*e*, as illustrated in FIG. 7.

The cable supply and storage assembly R also includes a means, generally 66, for controlling the rotation of the supply reel 60 thereby controlling the rate of electrical cable E is supplied to and received from the rig floor sheave assembly S and the feeding and withdrawal rate into and from the well bore. The rotation rate control means 66 may include any conventional power and breaking apparatus, such as a hydraulic motor and brake assembly of conventional design, positioned on the frame 62 which is connected with the supply reel 60 such as by sprockets 66*a*, 60*a* and chain 68.

The supply reel assembly R is also provided with a winch assembly 80, preferably mounted with the frame 62 adjacent the reel end wall 60*c* for transporting one end of the electrical cable E between the cable reel assembly R and the rig floor sheave assembly S. The winch assembly 80 includes a specially designed connector 82 swivally mounted with the winch cable 84 which is adapted for threadable connection with the electrical cable terminal connector T1 for protecting it as it is transported between the supply reel assembly R and the sheave assembly S and as it is supported and arcuately moved with the anchor carrier assembly 20 over the sheave for insertion and removal to or from the well bore W. Further, the mounting of the winch assembly 80 adjacent the supply reel end wall 60*c* permits the electrical cable E and its terminal connector T1 to be positioned adjacent the end wall outer surface 60*f* whereby it can be automatically positioned on the reel 60 by rotation of the supply reel 60 in the direction of the arrow 74 illustrated in FIG. 7 and can be substantially automatically removed from the supply reel 60 by rotation in the direction of the arrow 79, as illustrated in FIG. 9.

In accordance with the method of the invention, the entire fixed length of the section of elctrical cable E is inserted into and removed from the well bore W, preferably in the tubular drill string D disposed in the well bore W, by employment of the inventive apparatus operated in the following manner. As illustrated in FIG. 1, the rig floor sheave assembly S is positioned over the well bore W on the rig floor F and the rotating tool joint 18*a* is threadably connected to the tubular drill string D extending through the rig rotary table T. The electrical cable supply and storage reel assembly R, having the entire section of electrical cable E helically wound thereon, is positioned at a location remote to the rig floor F. Additionally, the cable support anchor carrier assembly 20 is positioned in the previously mentioned first position forward of the sheave 10 in relationship with the supply reel assembly R, as illustrated.

The leading end of the electrical cable E with the terminal connector T2 is then transported from the cable supply reel assembly R, fed between the support plates 21 and 22 and under the pivotal catch member 25*a* of the carrier assembly 20 and positioned on the sheave 10 with the cable terminal connector T2 being positioned substantially in alignment with the well bore axis (FIG. 1). For convenience, the cable E may be transported by moving the sheave assembly winch cable 52 to the cable supply reel assembly R, connecting its protective connector 51 to the cable connector T2, and winching the electrical cable to the rig floor assembly S for such feeding and positioning.

The squirter wheel assembly 31 is then moved inwardly whereby the squirter wheels 31*a* and 31*b* engage the cable E forcing it downwardly on the sheave 10. After the winch cable protective connector has been disconnected from the electrical cable connector T2, the sheave 10 is drivingly rotated by activation of the rig assembly power source 40 and the electrical cable E is inserted into the tubular drill string D. The electrical cable E is continuously fed by powered sheave rotation until a sufficient length thereof has been inserted to permit it substantially free-fall downwardly through the drill string D.

At this point, the cable supply reel power and braking apparatus 66 is activated to brake the supply reel 60 rotation rate and thereby control the cable feeding rate. Additionally, the sheave assembly power source 40 is disengaged from the sheave 10 by deactivating a suitable clutch (not shown) and the squirter wheel assembly 31 is moved outward relative to the sheave circumferential edge 10*b* disengaging the squirter wheels 31*a* and 31*b* from the cable E.

Feeding of the cable E into the drill string D is then continued at a desired rate, controlled by the supply reel assembly braking apparatus 66, until the cable E has been unwound from the supply reel 60 except for a portion disposed under the pivoting gate member 72. Cable feeding is then completely stopped by fully braking the reel rotation and the reel assembly winch cable protective connector 82 is threadably connected with the electrical cable terminal connector T1 which has been rotating with the supply reel 60 in contact with the connector catch plate 73. Additionally, the trigger member 76 is moved to force the gate member 72 to its inward position for releasing the cable E from the supply reel 60 as previously described and illustrated in FIGS. 9 and 9A.

After the protective connector 82 has been connected, the reel assembly winch 80 is activated to pull the electrical cable E slightly from the supply reel 60 thereby transferring the full weighted tension thereto. The supply reel 60 is then rotated in the direction of arrow 79 (FIG. 9) whereby the cable passes between the inwardly positioned gate member 72 and the flange 71 thereby releasing the cable E therefrom, as previously described.

Cable feeding into the well bore W is then continued, which is controlled by operation of the supply reel winch assembly 80. As illustrated in FIG. 2, during this winch feeding the cable terminal connector T1 contacts the pivotal catch member 25*a* which causes axial movement of the connector support carrier assembly 20 from its forward position towards its second position. During this movement, the winch cable sheave 23 engages the winch cable 84 whereby the terminal connector T1 and the protective connector 82 is positioned and supported between the support plates 21 and 22 outward from the sheave circumferential edge 10*b*. As the winch feeding is continued, the carrier assembly 20 axially rotates supporting and arcuately carrying the terminal connector T1 and protective connector 82 outwardly and over the sheave circumferential edge 10*b* until the assembly 20 moves to the second position illustrated in FIG. 3, whereby the entire length of cable E is in substantial alignment with the well bore axis. As the carrier assembly 20 reaches the second position, the dog 25*e* connected with the pivotal catch member shaft 25*f* engages the frame butt 12*f* which forces the catch member outwardly from between the support plates 21 and 22 automatically disengaging contact of the catch member 25*a* with the cable terminal connector T1 to permit the feeding of the cable to continue without interference until it has been entirely positioned in the drill string, as illustrated in FIG. 4, with the terminal connector T1 contacting a cable support member (not shown) previously placed in the drill string.

Further, in accordance with the method of the invention, the entire fixed length of electrical cable E is removed from the drill string D by employing the reverse of several of the cable feeding steps described hereinabove. More particularly, in cable removal the apparatus of the invention is initially positioned as illustrated in FIG. 4 wherein the conductor carrier assembly 20 is in the aforementioned second position in substantial alignment with the well bore axis. The supply reel winch cable 84 is threaded over the winch cable sheave 23, between the support plates 21 and 22 under the pivotal catch member 25*a* of the carrier assembly 20 and has its protective connector 82 threadably connected with the electrical cable connector T2. Initial cable withdrawal is carried out by operation of the supply reel winch assembly 80. During this initial winch removal the cable is pulled upwardly in substantially axial alignment with the tubular drill string until the winch protective connector 82 contacts the stop plate 24 mounted between the carrier assembly support plates 21 and 22 which prevents further movement of the winch cable 84 over the sheave 23. Further winching causes the assembly 20 to move towards its forward position during which the protective connector 82 and cable terminal connector T1 are supported and arcuately moved outwardly over the sheave 10 thereby preventing excessive bending of the terminal connector T1 and the conductor C at the aforementioned conductor-connector interface.

As the carrier assembly 20 axially rotates with the continued winching, the electrical cable E contacts and is positioned on the sheave 10. Further, the carrier assembly 20 continues to rotate until it reaches a position where its weight permits it to fall to the aforementioned forward position during which contact between the stop member 24 and the protective terminal connector 82 and the winch cable 84 and winch cable sheave 23, respectively, are broken thereby freeing the protective and terminal connectors 82, T1 from the carrier assembly 20 as illustrated in FIG. 2.

The electrical cable E is then transported to the remotely located supply and storage reel assembly R until the terminal connector T1 is positioned in alignment for engagement with the grooved catch member 73 of the supply reel 60, as illustrated in FIGS. 7, 7A. The supply reel 60 is then rotated by activation of the power and braking apparatus 66 until the terminal connector T1 and cable C contact the catch plate 73 and weighted tension is transferred to the supply reel 60 from the winch assembly 80. The winch cable protective connector 82 is then disconnected from the terminal connector T1 and the supply reel 60 is further rotated in the direction of arrow 74 in FIG. 7, causing the cable E to be forced downwardly between the flange 71 and the gate member 72 moving the gate member sufficiently to permit the passage of the cable E therebetween and under the gate member 72 as previously described and illustrated in FIGS. 8 and 8A. The electrical cable E can then be readily withdrawn from the tubular drill string D substantially tangentially over the sheave 10 and helically wound for storage on the supply reel 60 by rotating the supply reel 60 at a desired rate employing the power and braking apparatus 66 until the entire cable length has been removed.

If desirable, during the feeding or removal of the cable E to or from the tubular drill string D, the drill string D may be axially rotated so as to reduce the possibility of the cable E getting stuck therein. Additionally, if desirable, cable feeding can be facilitated by initially positioning a weighted, pre-wired sinker bar in the drill string D and connecting the terminal connector T2 thereto. The weighted sinker bar increases the weight of the cable being fed into the drill string so as to increase the free-fall feeding rate, if desired, and could also provide sufficient means for connecting with the downhole motor, telemetry sensor apparatus, and the like, to which electrical power is to be transmitted.

The foregoing disclosure and description of the invention are illustrative and explanatory thereof, and various changes in the size, shape, and materials as well as in the details of the illustrated construction may be made without departing from the spirit of the invention.

We claim:

1. An apparatus for handling fixed lengths of one or more sections of electrical cable having substantially rigid terminal electrical connectors at the end of each cable conductor section for the deployment and retrieval of the entire fixed length of the cable section into and from a well bore, said apparatus comprising, in combination:

a rig floor assembly adapted for positioning over the well bore including means for substantially tangentially feeding and withdrawing the entire length of each electrical cable section into and from the well bore, and means for preventing excessive bending of one of the cable terminal connectors and the cable conductor at an interface between the conductor and the connector of each cable section with the electrical cable being fed into or withdrawn from the well bore; and an apparatus for supplying and receiving a fixed length of at least one electrical cable section to and from said rig floor assembly for said feeding and withdrawing into and from the well bore, said apparatus including a reel for winding and unwinding the section of electrical cable having means for preventing excessive bending of at least one of the terminal connectors and the cable conductor of the cable section at an interface between said conductor and said terminal connector with said section of cable being wound or unwound to or from said reel.

2. The apparatus of claim 1, wherein said rig floor assembly includes:

a sheave assembly for receiving the electrical cable from said cable supply and receiving apparatus and for feeding and withdrawing the fixed length of electrical cable into and from the well bore; and means for positioning the sheave over the well bore whereby a portion of the sheave circumferential edge is substantially in alignment with the well bore axis.

3. The apparatus of claim 1, wherein the means for preventing excessive bending of said electrical cable section of said rig floor assembly includes:

means for supporting one of the terminal connectors of said electrical cable section for arcuate movement separately of cable feeding and withdrawing means with the cable being fed into or withdrawn from the well bore.

4. The apparatus of claim 3, wherein the connector support means includes:

means for releasably retaining and supporting one of said cable terminal connectors outward from the cable feeding and withdrawing means for said separate arcuate movement with the cable being fed into or removed from the well bore.

5. The apparatus of claim 1, wherein said rig floor assembly further includes:

means for increasing frictional forces between the electrical cable and the means for feeding and withdrawing the section of electrical cable, with the cable being positioned on said feeding and withdrawing means to prevent slippage therebetween.

6. The apparatus of claim 1, wherein said rig floor assembly further includes:

means for connecting said assembly with a tubular drill string disposed in the well bore, said connecting means being rotatable relative to the rig floor assembly to permit axial rotation of the tubular drill string with said electrical cable being fed into or withdrawn from said tubular drill string.

7. The apparatus of claim 1, wherein said rig floor assembly further includes:

means for transporting one end of the fixed length of an electrical cable section between said cable supplying and receiving apparatus and said rig floor assembly.

8. The apparatus of claim 1, wherein the means for preventing excessive bending of cable terminal connector and conductor of the electrical cable supplying and receiving apparatus includes:

releasable means for positioning at least one of the electrical cable terminal connectors with the reel for rotation therewith until the cable is unwound except for the connector and a portion of the conductor and thereafter releasing the connector and conductor portion from the reel to thereby release the entire length of the cable from the reel.

9. The apparatus of claim 8, wherein said releasable means is mounted on one end of said reel.

10. The apparatus of claim 9, wherein said releasable means includes:

means for releasably positioning said cable terminal connector outwardly relative to said reel end for rotation therewith.

11. The apparatus of claim 10, including means for positioning the electrical cable on said reel inwardly of said reel end with the cable being wound thereon and withdrawn from said well bore and for positioning said cable outwardly from the reel end with cable being unwound therefrom and being fed into said well bore.

12. The apparatus of claim 8, including:

means for controlling the rotation of the reel for supplying and receiving the section of electrical cable to and from said rig floor assembly at a desired rate for controlling the rate the cable section is fed into or withdrawn from the well bore.

13. The apparatus of claim 8, including:

means for transporting the electrical cable from the cable supply apparatus to the well bore with the electrical cable being unwound from the supply apparatus reel and being fed into the well bore and for transporting the electrical cable from the well bore to the supply apparatus supply reel with said cable being withdrawn from said well bore for winding said cable on said supply reel.

14. A method for alternately installing and removing into and from a well bore an entire fixed length of one or more sections of an electrical cable having substantially rigid terminal connectors at the ends of each cable conductor section to transport electrical energy between the surface and a subsurface location in the well bore, said method comprising:

alternately feeding or withdrawing the entire fixed length of a section of electrical cable into and from the well bore from or to a location remote to the well bore; and supporting and arcuately moving one of the rigid cable terminal connectors while preventing excessive bending of said supported rigid terminal connector and the electrical cable conductor at an interface between the conductor and supported connector with the section of electrical cable being substantially disposed within the well bore during said feeding or withdrawing of the cable into or from the well bore.

15. The method of claim 14, including the steps of:

positioning a leading terminal connector of said cable supplied from a remote location relative to the well bore in substantially axial alignment with the well bore;

substantially tangentially feeding the length of cable into the well bore until a trailing terminal connector of the cable approaches a position for tangential feeding into said well bore; and supporting and arcuately moving the trailing terminal connector from said position to substantial axial alignment with the well bore to prevent said excessive bending of the trailing connector and connector-conductor interface as the cable is continuously fed into the well bore.

16. The method of claim 15, wherein:

the electrical cable is driven into the well bore until a sufficient length of cable has been fed therein to permit substantial free-fall of the cable in the well bore.

17. The method of claim 16, wherein:

the rate the electrical cable is then fed into the well bore is controlled by controlling the rate the electrical cable is supplied from said remote location.

18. The method of claim 14, including the steps of:

supporting and arcuately moving a leading terminal connector end of the fixed length of electrical cable disposed in the well bore from a position in substantial axial alignment with the well bore to a position substantially tangential relative to the well bore axis to prevent excessive bending of said leading terminal connector and an interface between the supported terminal connector and cable conductor;

transporting the leading terminal connector of said cable to a remote location relative to the well bore for storage of said cable upon withdrawal from the well bore; and substantially tangentially withdrawing the cable from the well bore until the entire length of cable has been withdrawn therefrom and transported to said remote location.

19. The method of claim 18, including the steps of:

controlling the rate of substantially tangentially withdrawing the cable from the well bore at a remote location relative to the well bore.

20. The method of claim 18, wherein the electrical cable is helically wound at a remote location relative to the well bore for storage as it is simultaneously substantially tangentially withdrawn from the well bore.

* * * * *